United States Patent [19]

Martin

[11] Patent Number: 4,832,566

[45] Date of Patent: May 23, 1989

[54] AXIAL FLOW ELASTIC FLUID TURBINE WITH INLET SLEEVE VIBRATION INHIBITOR

[75] Inventor: Harry F. Martin, Altamonte Springs, Fla.

[73] Assignee: Westinghouse Electric Corp., Pittsburgh, Pa.

[21] Appl. No.: 152,287

[22] Filed: Feb. 4, 1988

[51] Int. Cl.[4] ..... F01D 25/28

[52] U.S. Cl. ..... 415/119; 415/183; 415/220

[58] Field of Search ..... 415/119, 134, 182, 139, 415/183, 184, 185, 219 R

[56] References Cited

U.S. PATENT DOCUMENTS

| | | | |
|---|---|---|---|
| 2,294,127 | 8/1942 | Pentheny | 415/185 X |
| 2,651,495 | 9/1953 | Corbett | 415/139 |
| 3,907,308 | 9/1975 | Stock | 415/138 X |
| 4,362,464 | 12/1982 | Stock | 415/136 |

FOREIGN PATENT DOCUMENTS

| | | | |
|---|---|---|---|
| 4209 | 9/1979 | European Pat. Off. | 415/119 |
| 56-38597 | 4/1981 | Japan | 415/119 |
| 59-46391 | 3/1984 | Japan | 415/119 |
| 60-73086 | 4/1985 | Japan | 415/119 |
| 783970 | 10/1957 | United Kingdom | 415/134 |

*Primary Examiner*—Robert E. Garrett
*Assistant Examiner*—Joseph M. Pitko

[57] ABSTRACT

An axial flow elastic fluid turbine has a vibration inhibitor for the inlet sleeves which extend through a motive fluid flow area between the inner and outer cylindrical casings of the turbine. The vibration inhibitor comprises a flexible support, preferably in the form of a metal plate, that is secured to, and extends between, adjacent inlet sleeves in the motive fluid flow area between the inner and outer cylindrical casings, and the plates have at least one bend therein in the direction of the radius of the casings to permit flexibility thereof.

7 Claims, 3 Drawing Sheets

AXIAL FLOW ELASTIC FLUID TURBINE WITH INLET SLEEVE VIBRATION INHIBITOR

The invention relates to an axial flow fluid turbine apparatus such as a high pressure steam turbine, and particularly to a turbine having a vibration inhibitor for the inlet sleeves of the turbine.

Axial flow turbines are normally formed from concentric inner and outer cylindrical casings, with a main conduit for an elastic fluid, such as steam, charging the steam into a nozzle chamber on the interior of the turbine apparatus through conduits which pass through both of the cylindrical casings. These conduits, as described in U.S. Pat. No. 3,907,308, assigned to the assignee of the present invention, the contents of which are incorpoarated by reference herein, are preferably neck portions that extend outwardly from the inner cylinder nozzle chamber, and inlet conduits or sleeves that are formed with the outer cylindrical casing, with sealing devices used therebetween. This arrangement provides a direct passage for steam from outside the outer cylindrical casing to the interior nozzle chamber while compensating for the differential thermal expansion of the inner and outer cylinders. The inlet sleeves extend radially inwardly from the outer cylinder, across the spacing between the outer and inner cylinders, and into the neck portions of the inner cylinder nozzles. The spacing between the inner and outer cylinders is also a flow area for the steam, which is initially charged through the inlet sleeves, through the nozzle chambers to nozzle blocks through which the steam is initially expanded, through a series of stationary nozzle vanes and rotatable turbine blades to impart motion to the rotatable blades, and after expansion therein, through the spacing or flow area past the inlet sleeves extending across that area, prior to being further expanded through a further series of stationary vanes and rotating blades, and thence to other turbine expansion stages or desired flow.

The inlet sleeves thus extend through a flow area for the steam passing through a high pressure turbine, and these sleeves sometimes fail from high cycle fatigue. At times, such inlet sleeves have been found to have cracks or have been broken completely. A complete failure would result in a steam leak and loss of efficiency. In addition, this could lead to other damage such as wear of the bell seal, a preferred sealing device between the inlet sleeve and the nozzle neck, or cracking of that seal. It is believed that such cracks are caused by flow induced vibration which can be caused by the valve upstream of the sleeve, the flow inside the sleeve, or the flow outside the sleeve which flows across the sleeve.

It is an object of the present invention to provide a vibration dampening device that will provide an inlet sleeve structure of enhanced rigidity in an axial flow elastic fluid turbine.

SUMMARY OF THE INVENTION

With this object in view, the present invention resides in an axial flow elastic fluid turbine apparatus having an inlet vibration inhibitor, which apparatus has an outer cylinder, an inner cylinder radially spaced from the outer cylinder to form a motive fluid flow area therebetween, a plurality of nozzle chambers on the inner cylinder, a plurality of inlet sleeves, one for each nozzle chamber, extending radially inwardly from the outer cylinder, through the flow area, for introducing an elastic fluid into each nozzle chamber, and means for providing flexible support to the inlet sleeves, extending between and secured to at least one pair of the plurality of inlet sleeves, the flexible support means disposed in the flow area formed between the outer cylinder and the inner cylinder.

The flexible support is preferably in the form of a metal plate, one end of which is secured to the outer surface of a sleeve and the other end secured to the outer surface of an adjacent sleeve, with at least one bend formed in the metal plate between the two ends, and preferably two bends provided, one adjacent each end of the metal plate.

The present invention provides an axial flow turbine having improved protection of the inlet sleeve from cracking caused by flow induced vibration and is easily retrofitted to existing turbine units with a minimum of unit off-line outage time, as well as being useful in new turbines.

p DESCRIPTION OF THE DRAWINGS

The invention will become more readily apparent from the following description of preferred embodiments thereof shown, by way of example only, in the accompanying drawings wherein.

DETAILED DESCRIPTION

Figure 1:
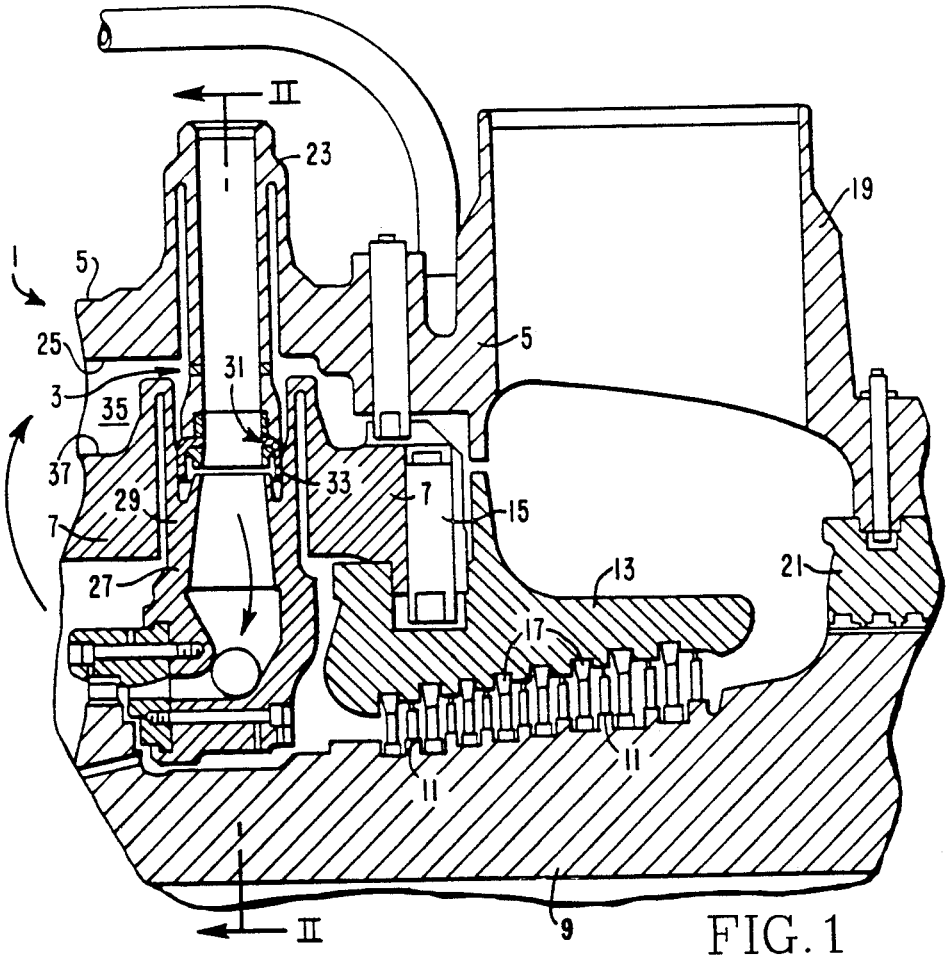
FIG. 1 is a view in longitudinal section of a portion of a high pressure turbine apparatus using a flexible support as an inlet vibration inhibitor of the present invention.
Figure 2:
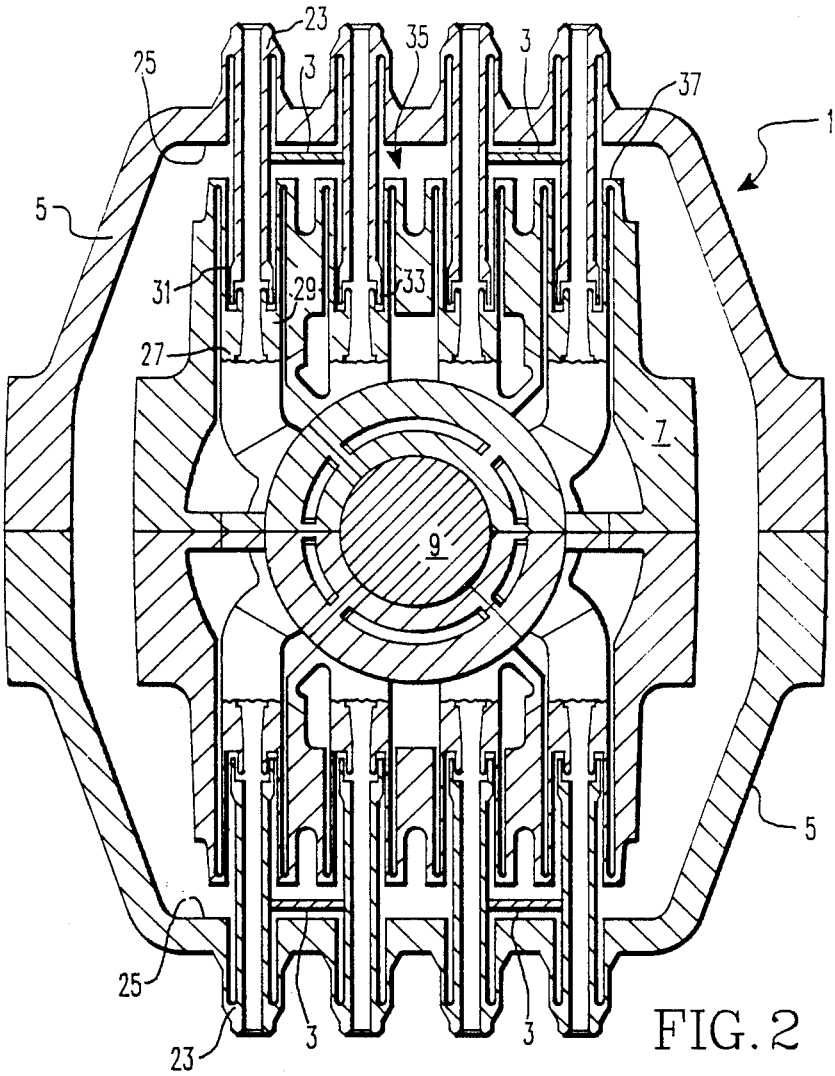
FIG. 2 is a sectional view taken along lines II—II of FIG. 1.

Referring now to FIGS. 1 and 2, there is illustrated a longitudinal sectional view of a portion of a high pressure turbine, an axial flow elastic fluid turbine apparatus 1 having an inlet sleeve vibration inhibitor or flexible support 3. The turbine 1 comprises an outer cylinder 5 which surrounds an inner cylinder 7. The outer cylinder 5 and inner cylinder 7 surround a rotor 9 which has a plurality of rotating blades 11 thereon. A blade ring 13 is attached to the inner cylinder 7 and is restrained by restraining means 15, while a plurality of stationary nozzle blades 17 are attached to the blade ring 13. A high pressure exhaust 19 integral with outer cylinder 5 conducts the motive fluid that has passed through the turbine blading to associated intermediate or lower pressure turbine elements. Seals 21 prevent escape of the motive fluid from the interior of the outer cylinder 5.

In the embodiment of the axial flow elastic fluid turbine illustrated, a plurality of steam inlet conduits or sleeves 23 are formed integrally with or attached to the outer cylinder 5 and extend a predetermined distance inwardly on a vertical line from the inner surface 25 of outer cylinder 5 toward the rotating shaft or rotor 9. A nozzle chamber 27 integral with the inner cylinder 7 has a vertically outwardly extending neck portion 29 which overlaps but does not contact the innermost portion 31 of the inlet sleeve 23. A sealing device 33, such as a bell seal, disposed between the innermost portion 31 of the inlet sleeve 23 and the inner surface of the nozzle chamber neck portion 29, provides a flexible, movable seal arrangement between adjacent portions of the inlet sleeve 23 integral with the outer cylinder 5 and the nozzle chamber neck portion 29 integral with the inner cylinder 7. The flow of motive fluid, such as steam, as illustrated by the arrows in FIG. 1, is radially inwardly through the inlet sleeve 23, and axially through vanes and blades (not shown at the left portion of the figure) to impart motion to the rotor for the purpose of doing useful work. After exiting this area, some of the fluid passes through the flow area 35 between the inner surface 25 of the outer cylinder 5 and the outer surface 37 of the inner cylinder 7, past the inlet sleeves 23, prior to exhausting through 19. The remainder and major portion of the fluid is further expanded through the alternating annular arrays of rotating blades 11 and stationary blades 17. After further expansion through the rotating and stationary blades 11 and 17, the fluid is normally directed to other turbine stages, to a heat recovery or heat rejection device, or to any other desired flow path.

Figure 3:
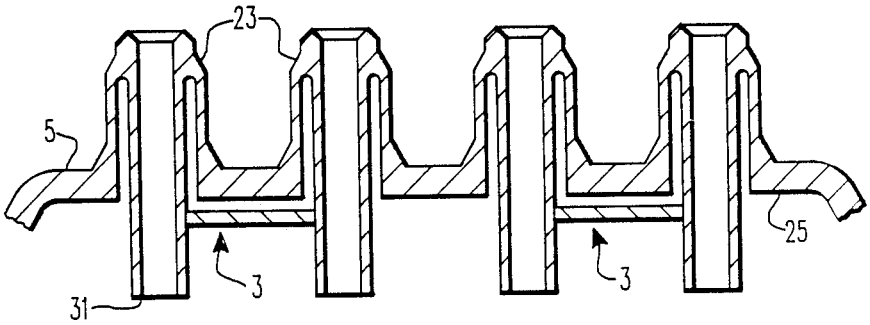
FIG. 3 is a partial view of the vibration inhibitor shown in FIG. 2.
Figure 4:
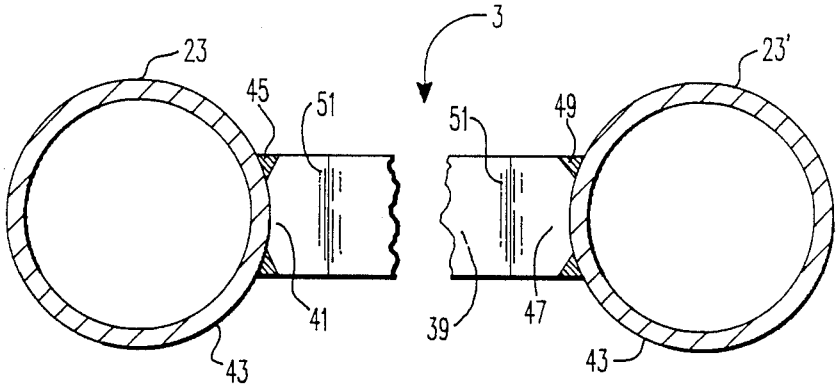
FIG. 4 is a plan view of a flexible support attached to an adjacent pair of inlet sleeves.
Figure 5:
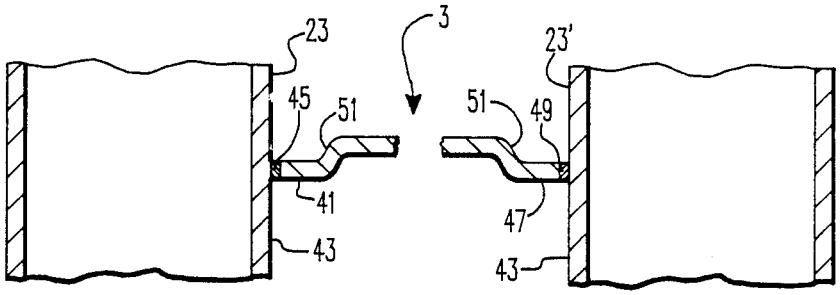
FIG. 5 is a vertical sectional view of the flexible support illustrated in FIG. 4.

The positioning of the inlet sleeve vibration inhibitor 3 is illustrated in FIGS. 2 and 3, wherein a turbine having four inlet sleeves 23 has a flexible support 3 disposed between two adjacent pairs of the four inlet sleeves. The inlet sleeve vibration inhibitor or flexible support 3, as illustrated in FIGS. 4 and 5 comprises a flexible metallic plate 39 extending between a pair of adjacent inlet sleeves 23, 23', with one end 41 of the plate 39 secured to the outer surface 43 of a sleeve 23 such as by weld 45, while the other end 47 of the plate 39 is secured to the outer surface 43 of the adjacent sleeve 23' such as by weld 49. The flexible metal plate 39, as illustrated in FIG. 5, preferably has at least one bend 51 along the length thereof to provide radial flexibility to the plate, with a bend 51 preferably provided adjacent each of the ends 41, 47. The bends of the plate are in the direction of the radius of the inner and outer cylindrical casings to permit flexible movement of the sleeves in that radial direction.

The inlet sleeves are generally formed from a steel alloy such as a 2.25% by weight chromium, 1% by weight molybdenum, iron alloy. It would be expected to form the flexible support from the same or similar alloy to provide the flexibility and withstand the steam environment in which it will be disposed. The flexibility that is needed in the support or metal plate must be sufficient to accommodate the possibility of different temperatures in the sleeves due to portional steam admission and the fact that the plate would be immersed in a steam environment that could be significantly less temperature than the fluid inside the sleeve. Typically, a radial deflection of between about 0.051 to 0.076 cm (0.020 to 0.030 inch) must be tolerated.

Figure 6:
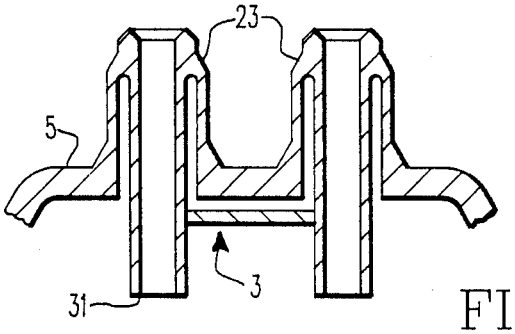
FIG. 6 is a sectional view of a vibration inhibitor disposed between the inlet sleeves of a turbine having only two adjacent sleeves.

The embodiment illustrated in FIG. 6 shows a flexible support 3 disposed between the two inlet sleeves of an axial flow elastic fluid turbine where only two inlet sleeves for the motive fluid are present on the turbine.

The present invention provides a structure of greater stability to inhibit flow induced vibration of the inlet sleeves of a high pressure steam turbine. The flexible support of the plates allow sufficient flexibility to account for the steady state and transient temperature differences that can exist between such inlet sleeves, and is especially useful when flow induced forces are exciting only one of a plurality of inlet sleeves.

I claim:

1. An axial flow elastic fluid turbine apparatus with inlet sleeve vibration inhibitor comprising:

an outer cylinder;

an inner cylinder radially spaced from said outer cylinder to form a motive fluid flow area therebetween;

a plurality of nozzle chambers on said inner cylinder;

a plurality of inlet sleeves, for said nozzle chambers, extending radially inwardly from said outer cylinder, through said flow area, for introducing an elastic fluid into each said nozzle chamber; and means for providing flexible support to said inlet sleeves, while permitting flexible movement of said inlet sleeves between and in the direction of said radially spaced inner and outer cylinders, extending between and secured to at least one pair of said plurality of inlet sleeves, the flexible support means disposed in said flow area formed between said outer cylinder and said inner cylinder.

2. An axial flow elastic fluid turbine apparatus with inlet sleeve vibration inhibitor as defined in claim 1 wherein said flexible support means comprises a metal plate, one end of which is secured to the outer surface of one said sleeve and the other end of which is secured to the outer surface on adjacent said sleeve.

3. An axial flow elastic fluid turbine apparatus with inlet sleeve vibration inhibitor as defined in claim 2 wherein the ends of said metal plate are secured to the outer surface of said adjacent sleeves by welds.

4. An axial flow elastic fluid turbine apparatus with inlet sleeve vibration inhibitor as defined in claim 2 wherein said metal plate has at least one bend therein between said one and said other end.

5. An axial flow elastic fluid turbine apparatus with inlet sleeve vibration inhibitor as defined in claim 4 wherein two bends are provided in said metal plate, one adjacent each end thereof.

6. An axial flow elastic fluid turbine apparatus with inlet sleeve vibration inhibitor comprising:

an outer cylinder;

an inner cylinder radially spaced from said outer cylinder to form a motive fluid flow area therebetween;

a plurality of nozzle chambers on said inner cylinder;

a plurality of inlet sleeves, one for each nozzle chamber, extending radially inwardly from said outer cylinder, through said flow area, for introducing an elastic fluid into each said nozzle chamber; and a metal plate extending between and secured to at least one pair of said plurality of inlet sleeves, disposed in said flow area formed between said outer cylinder and said inner cylinder, permitting movement of said inlet sleeves between and in the direction of said radially spaced inner and outer cylinders, one end of said plate secured to the outer surface of one sleeve of said pair of sleeves and the other end secured to the outer surface of the other sleeve of said pair of sleeves, said metal plate having at least one bend therein between said one and said other end.

7. An axial flow elastic fluid turbine apparatus with inlet sleeve vibration inhibitor as defined in claim 6 wherein two bends are provided in said metal plate, one adjacent each end thereof.

* * * * *